US007385563B2

(12) United States Patent
Bishop

(10) Patent No.: US 7,385,563 B2
(45) Date of Patent: Jun. 10, 2008

(54) MULTIPLE ANTENNA ARRAY WITH HIGH ISOLATION

(75) Inventor: Bruce Foster Bishop, Aptos, CA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 11/519,162

(22) Filed: Sep. 11, 2006

(65) Prior Publication Data

US 2008/0062058 A1 Mar. 13, 2008

(51) Int. Cl.
*H01Q 21/00* (2006.01)
*H01Q 19/00* (2006.01)

(52) U.S. Cl. ..... 343/844; 343/725; 343/833; 343/834; 343/835

(58) Field of Classification Search ..... 343/833, 343/834, 835, 844, 725
See application file for complete search history.

(56) References Cited

U.S. PATENT DOCUMENTS 6,486,847 B1 11/2002 Yamamoto et al.
7,202,824 B1 * 4/2007 Sanelli et al. ..... 343/702
2005/0174298 A1 * 8/2005 Chiang et al. ..... 343/834
2006/0227062 A1 * 10/2006 Francque et al. ..... 343/893

* cited by examiner

*Primary Examiner*—Hoang V Nguyen

(57) ABSTRACT

A high-isolation multiple in, multiple out (MIMO) antenna array includes, in one configuration, a ground plane, and a plurality of antenna transmitting/receiving elements arranged near the periphery of the ground plane, wherein each of the antenna transmitting/receiving elements is resonant at a frequency f. Also, the array includes an isolation antenna element located on the ground plane, between the plurality of antenna transmitting/receiving elements. The isolation antenna element is also resonant at the same frequency f. The plurality of antenna transmitting/receiving elements and the resonant isolation antenna element are arranged on the ground plane arranged so as to achieve substantially greater than 15 dB isolation of the antenna transmitting/receiving elements. In some configurations, at least about 30 dB of isolation of the antenna transmitting/receiving elements can be achieved.

19 Claims, 12 Drawing Sheets

MULTIPLE ANTENNA ARRAY WITH HIGH ISOLATION

BACKGROUND OF THE INVENTION

This invention relates generally to antennas for the transmission and reception of radio frequency (RF) energy, and more particularly to methods and apparatus providing high isolation between transmitting/receiving elements of multiple element antenna arrays.

Multiple in, multiple out (MIMO) antenna system are sometimes used in wireless computer networks such as local area networks (LANs) or WI-FI service. A MIMO antenna system combines the antennas by controlling phase differences and/or amplitude or gain differences between the antennas. This combination is used to form different beam shapes to eliminate interference and/or to enhance a signal in a selected direction. Thus, a MIMO antenna system is, to some degree, similar to an adaptive array.

The antenna transmitting/receiving elements used in a MIMO array may inherently have 15 DB of isolation. Any combination of the transmitting/receiving elements can be used for receiving or transmitting. However, antenna transmitting/receiving elements having only 15 dB of isolation may not achieve the most effective beam steering or adaptive steering, especially with elements having the same individual directional pattern.

BRIEF DESCRIPTION OF THE INVENTION

In one aspect, some configurations of the present invention provide a high-isolation multiple in, multiple out (MIMO) antenna array. The array may include a ground plane, a plurality of antenna transmitting/receiving elements arranged near the periphery of the ground plane, wherein each of the antenna transmitting/receiving elements is resonant at a frequency f. Also, the array may include an isolation antenna element located on the ground plane, between the plurality of antenna transmitting/receiving elements. The isolation antenna element is also resonant at the same frequency f. The plurality of antenna transmitting/receiving elements and the resonant isolation antenna element are arranged on the ground plane arranged so as to achieve substantially greater than 15 dB isolation of the antenna transmitting/receiving elements. In some configurations, at least about 30 dB of isolation of the antenna transmitting/receiving elements can be achieved.

In another aspect, some configurations of the present invention provide a method for communicating via radio frequency (RF) energy. The method may include controlling at least one of phase or amplitude of RF energy to a plurality of antenna transmitting/receiving elements arranged near the periphery of a ground plane, wherein each of the antenna transmitting/receiving elements is resonant at least one frequency f. The method may also include providing at least one isolation antenna element located on the ground plane between the plurality of antenna transmitting/receiving elements. The isolation antenna element is also resonant at least the same frequency f. The plurality of transmitting/receiving elements and the resonant isolation antenna element are arranged on the ground plane so as to achieve substantially greater than 15 dB isolation between the antenna transmitting/receiving elements. In some configurations, 30 dB of isolation may be achieved.

In yet another aspect, some configurations of the present invention provide a method for making a high-isolation multiple in, multiple out (MIMO) antenna array. The method may include arranging a plurality of antenna transmitting/receiving elements near the periphery of a ground plane, wherein each of the antenna transmitting/receiving elements is resonant at least one frequency f. Also included is placing an isolation antenna element also resonant at least the same frequency f between the plurality of antenna transmitting/receiving elements, so as to achieve substantially greater than 15 dB isolation of the antenna transmitting/receiving elements.

It will be appreciated that some configurations of the present invention provide high isolation between the antenna transmitting/receiving elements, as well as a compact antenna that can be particularly useful for WIFI applications.

Figure 1:
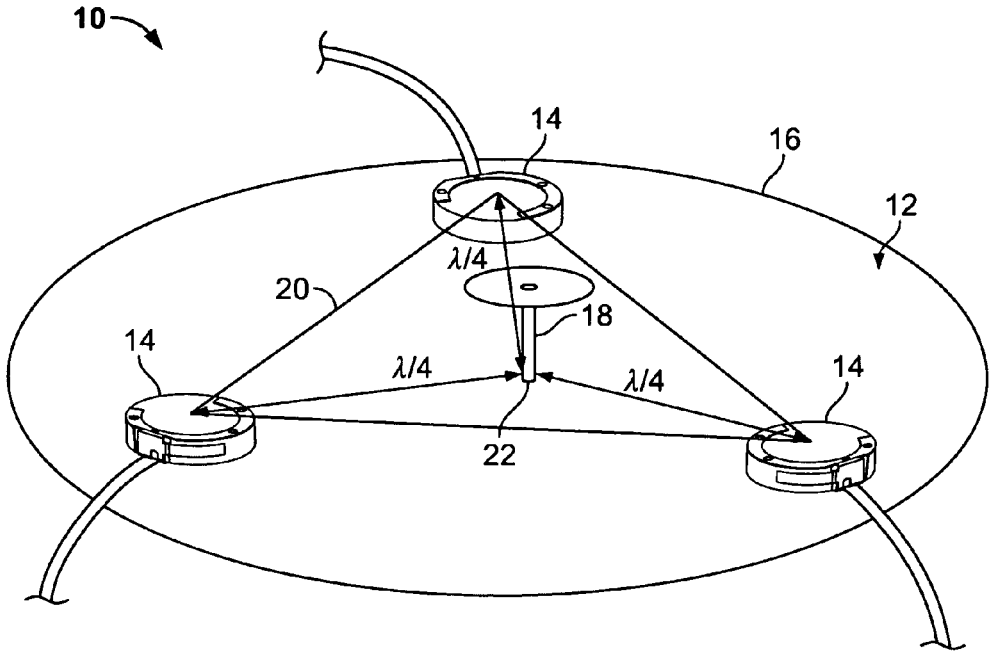
FIG. 1 is a pictorial drawing of one configuration of a high-isolation, multiple in, multiple out (MIMO) antenna array.

The foregoing summary, as well as the following detailed description of certain embodiments of the present invention, will be better understood when read in conjunction with the appended drawings. To the extent that the figures illustrate diagrams of the functional blocks of various embodiments, the functional blocks are not necessarily indicative of the division between hardware circuitry. It should be understood that the various embodiments are not limited to the arrangements and instrumentality shown in the drawings.

DETAILED DESCRIPTION OF THE INVENTION

As used herein, an element or step recited in the singular and proceeded with the word "a" or "an" should be understood as not excluding plural said elements or steps, unless such exclusion is explicitly stated. Furthermore, references to "one embodiment" of the present invention are not intended to be interpreted as excluding the existence of additional embodiments that also incorporate the recited features. Moreover, unless explicitly stated to the contrary, embodiments "comprising" or "having" an element or a plurality of elements having a particular property may include additional such elements not having that property.

In some configurations of the present invention and referring to FIG. 1, a high-isolation, multiple in, multiple out (MIMO) antenna array 10 is provided. Array 10 can include a ground plane 12 and a plurality of antenna transmitting/receiving elements 14 arranged near a periphery 16 of ground plane 12. Each of the plurality of antenna transmitting/receiving elements 14 is resonant at least one frequency f. One type of suitable antenna transmitting/receiving element 14 is Tyco Electronics Part No. 1513164-1 antenna assembly, shown in FIG. 2, which is resonant in both the 2.4 GHz and 5 GHz WIFI bands, however, other types of antenna elements can also be used. Returning to FIG. 1, array 10 also includes at least one isolation antenna element 18 located on ground plane 12, between the plurality of transmitting/receiving elements 14. The at least one isolation antenna element 18 is resonant at the same frequency f as are antenna transmitting/receiving elements 14, and need not be the same type of element as antenna transmitting/receiving elements 14. For example, a top loaded isolation antenna element 18 can be used. Isolation antenna element 18 is not powered or connected to a load. Antenna transmitting/receiving elements 14 may inherently have 15 DB of isolation. However, in various configurations of the present invention, antenna transmitting/receiving elements 14 and the at least one isolation antenna element 18 are arranged on ground plane 12 so as to achieve substantially greater than 15 dB isolation of antenna transmitting/receiving elements 14 with one another.

Surprisingly, by placing a resonant isolation antenna element 18 (such as, for example, a monopole element) between antenna/receiving elements 14, 30 DB of isolation can be achieved. Thus, in some configurations of the present invention, the plurality of antenna transmitting/receiving elements 14 and resonant isolation antenna element 18 are arranged on ground plane 12 so as to achieve approximately 30 dB isolation of the antenna transmitting/receiving elements 14. For example, in one suitable configuration, there are three antenna transmitting/receiving elements 14 arranged equidistant from one another at the vertices of an equilateral triangle 20, and a single isolation antenna element 18 is situated at center 22 of triangle 20, one quarter of a wavelength (λ/4, where $$\lambda = \frac{c}{2\pi f})$$

away from each transmitting/receiving element 14. Such an arrangement is particularly useful for WIFI service in the 2.4 GHz or 5 GHz bands, but configurations of the present invention are not limited to these frequency ranges.

Figure 2:
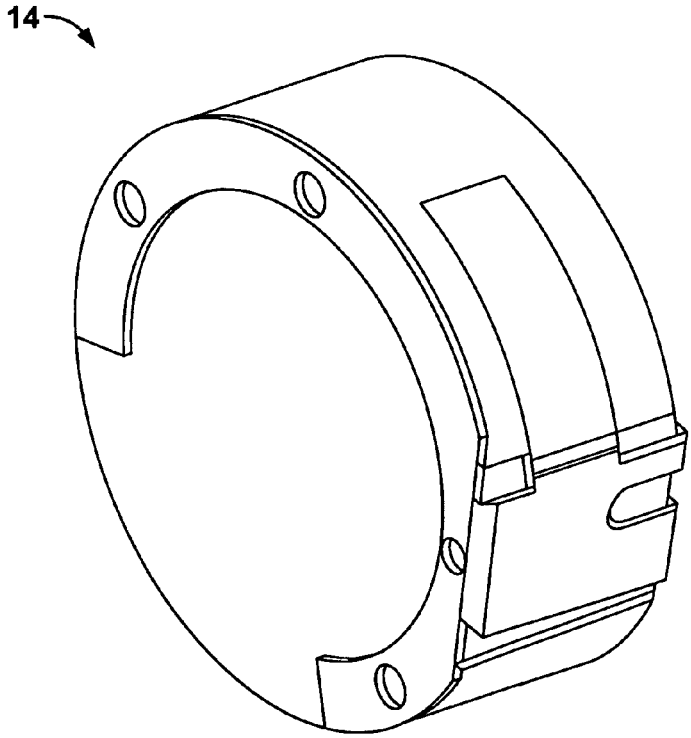
FIG. 2 is a pictorial drawing of one configuration of antenna transmitting/receiving element useful in the antenna array configuration of FIG. 1.
Figure 3:
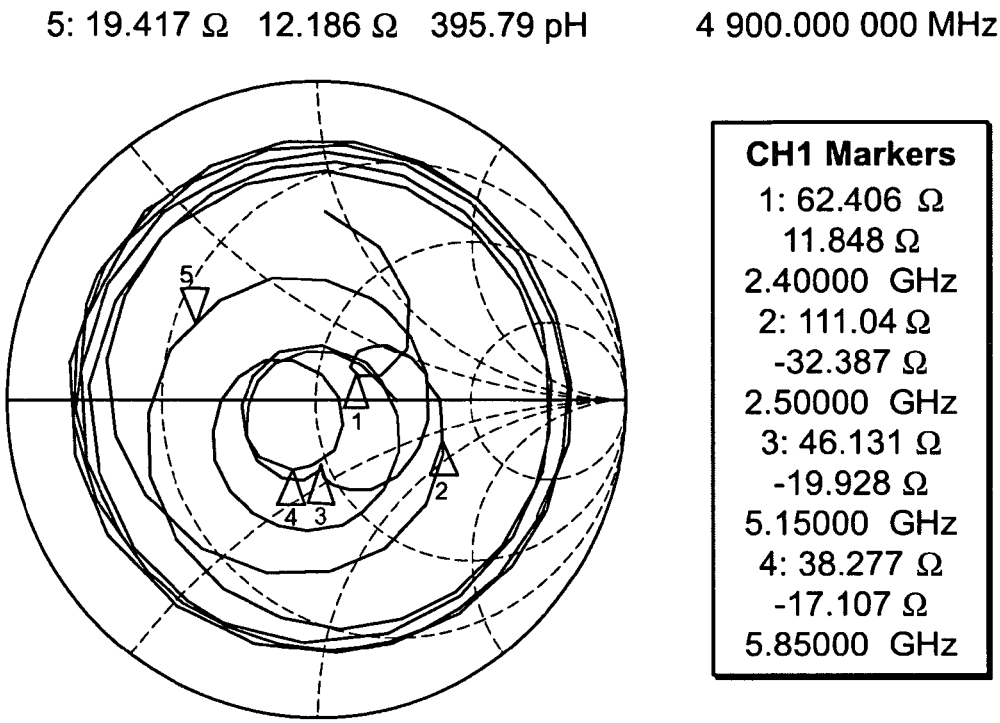
FIG. 3 is a graphical representation of the measured impedance, as a function of frequency, of a first one of the transmitting/receiving elements of the antenna array shown in FIG. 1.
Figure 4:
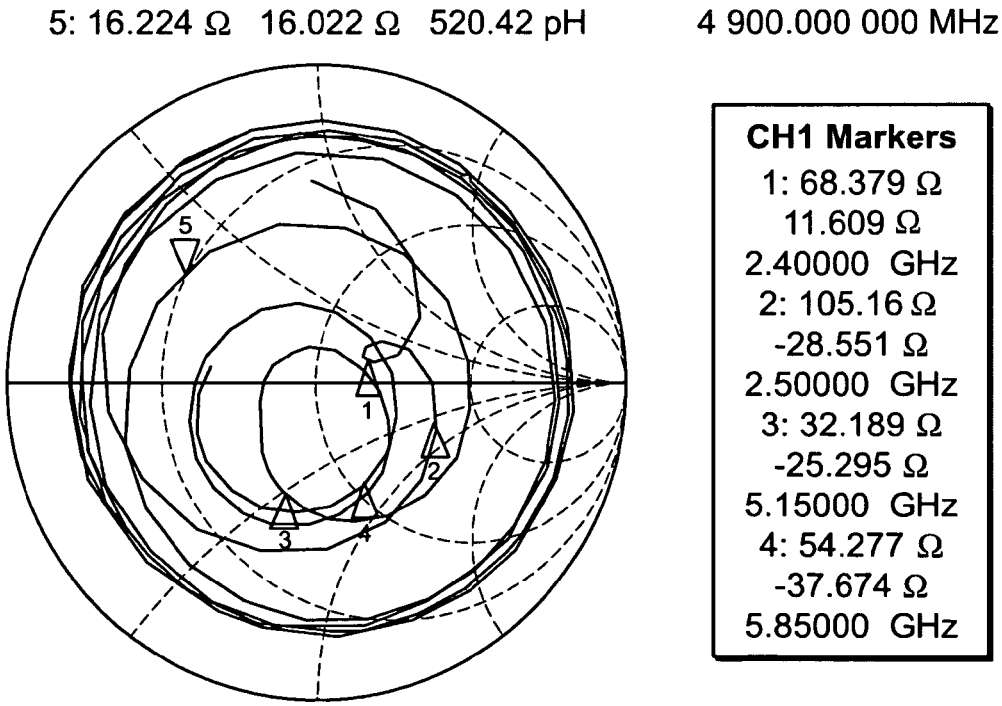
FIG. 4 is a graphical representation of the measured standing wave ratio (SWR), as a function of frequency, of the transmitting/receiving element represented by the graph of FIG. 3.
Figure 5:
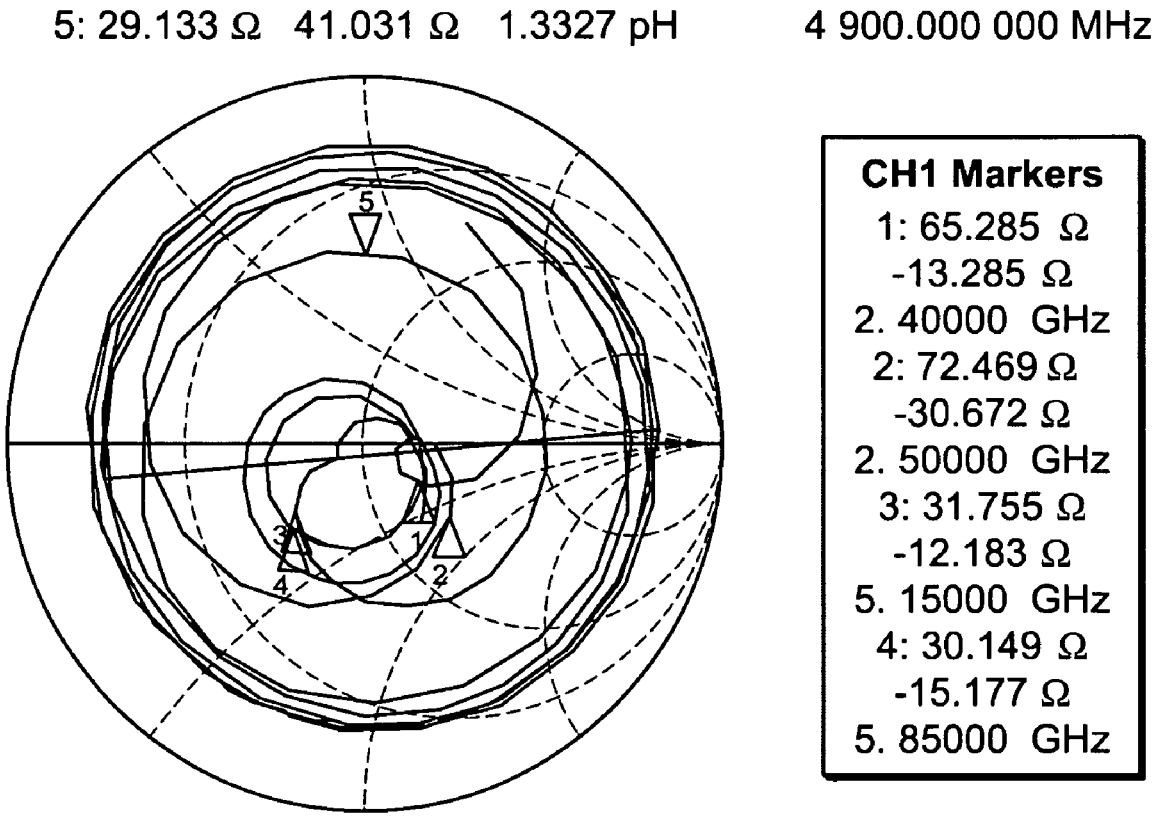
FIG. 5 is a graphical representation of the measured directional pattern, as a function of both frequency and angle, of the transmitting/receiving element represented by the graphs of FIGS. 3 and 4.
Figure 6:
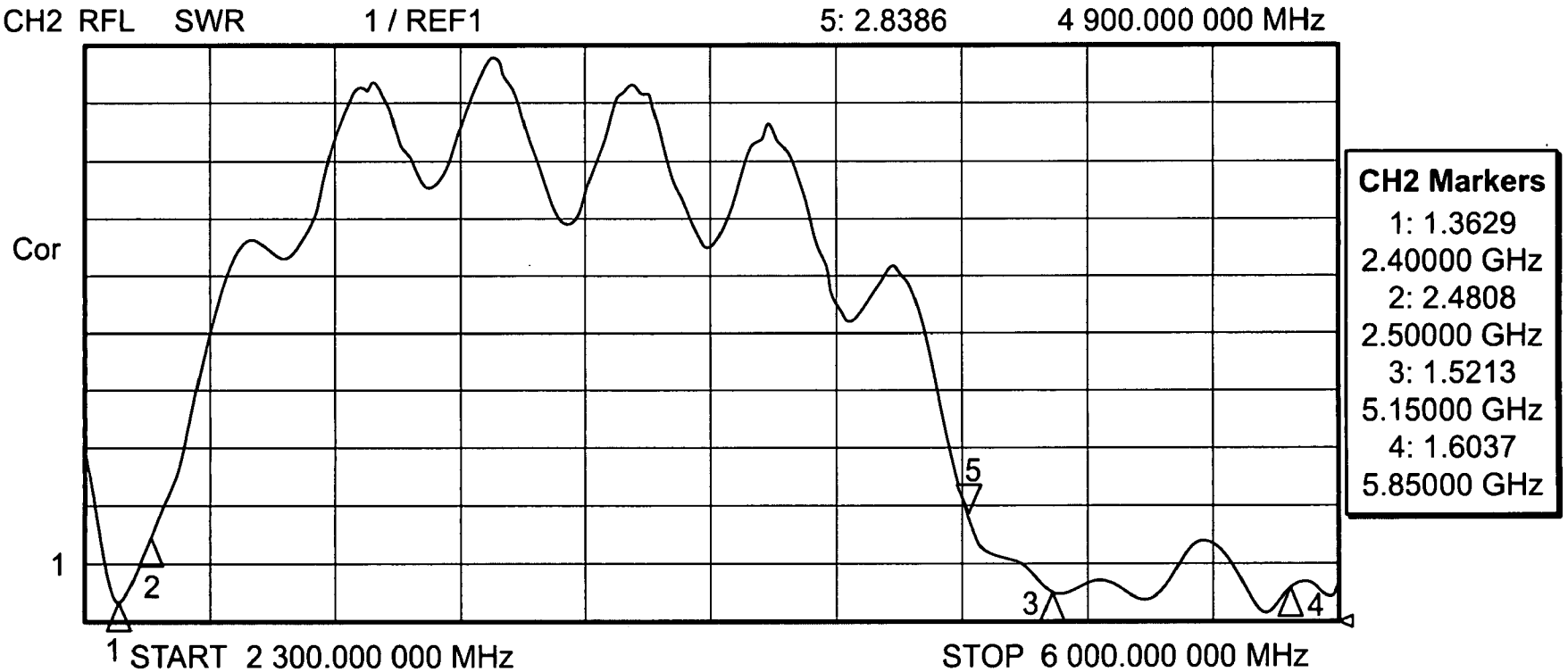
FIG. 6 is a graphical representation of the measured impedance, as a function of frequency, of a second one of the transmitting/receiving elements of the antenna array shown in FIG. 1.
Figure 7:
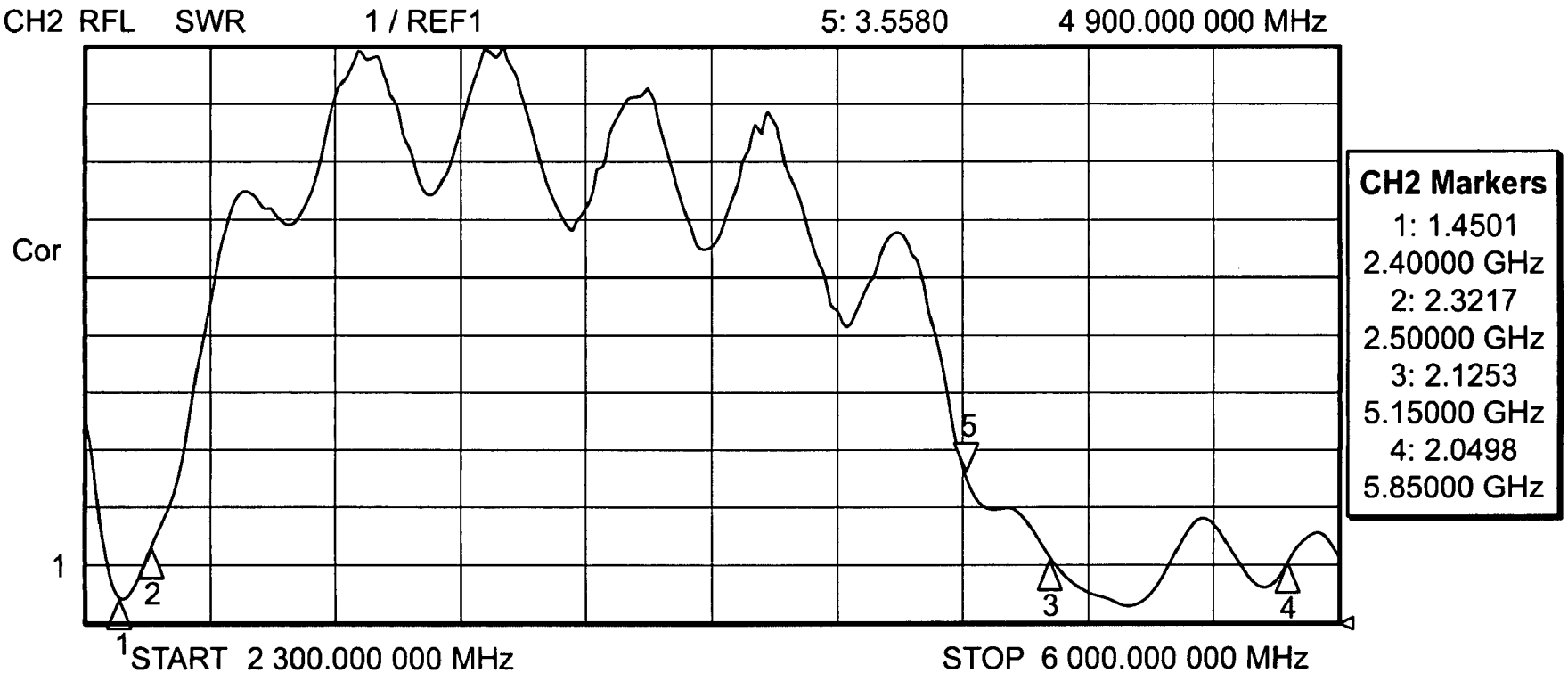
FIG. 7 is a graphical representation of the measured standing wave ratio (SWR), as a function of frequency, of the transmitting/receiving element represented by the graph of FIG. 6.
Figure 8:
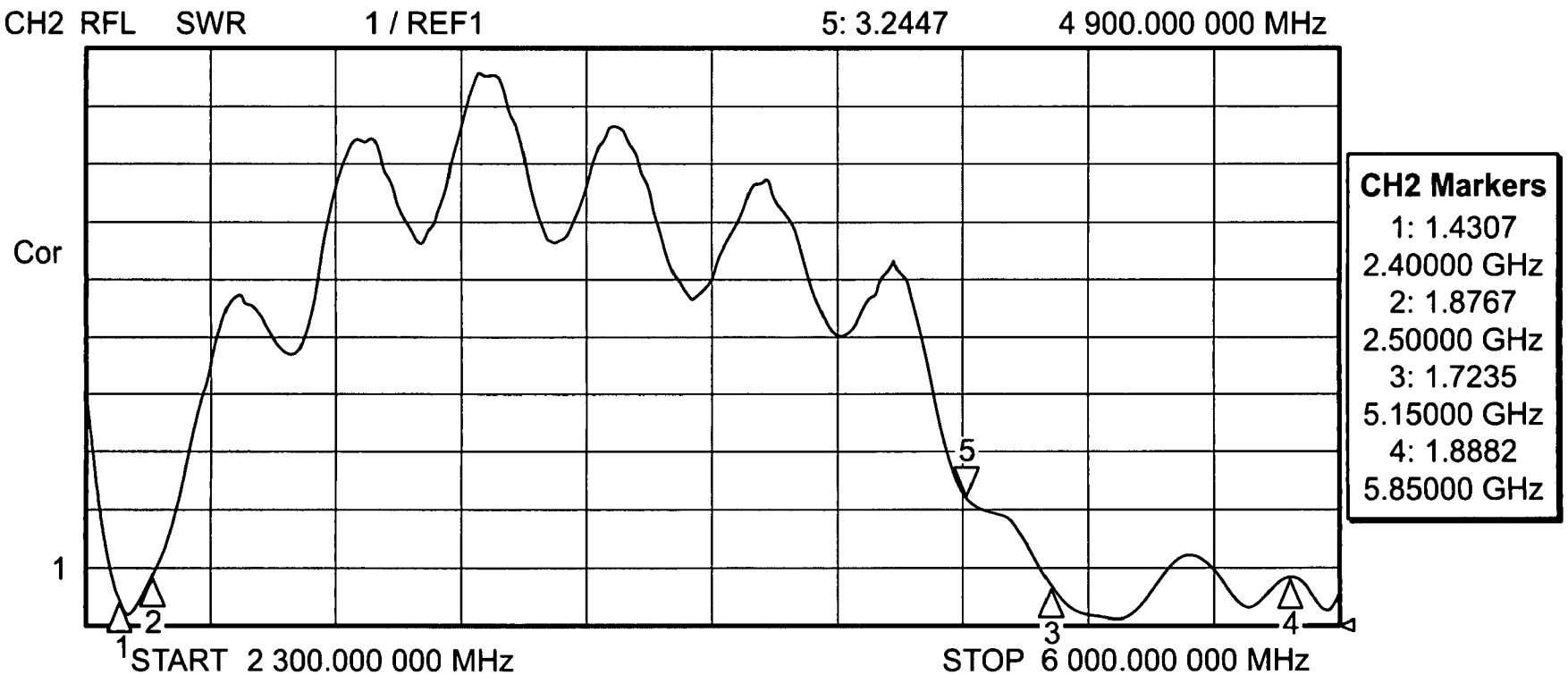
FIG. 8 is a graphical representation of the measured directional pattern, as a function of both frequency and angle, of the transmitting/receiving element represented by the graphs of FIGS. 6 and 7.
Figure 9:
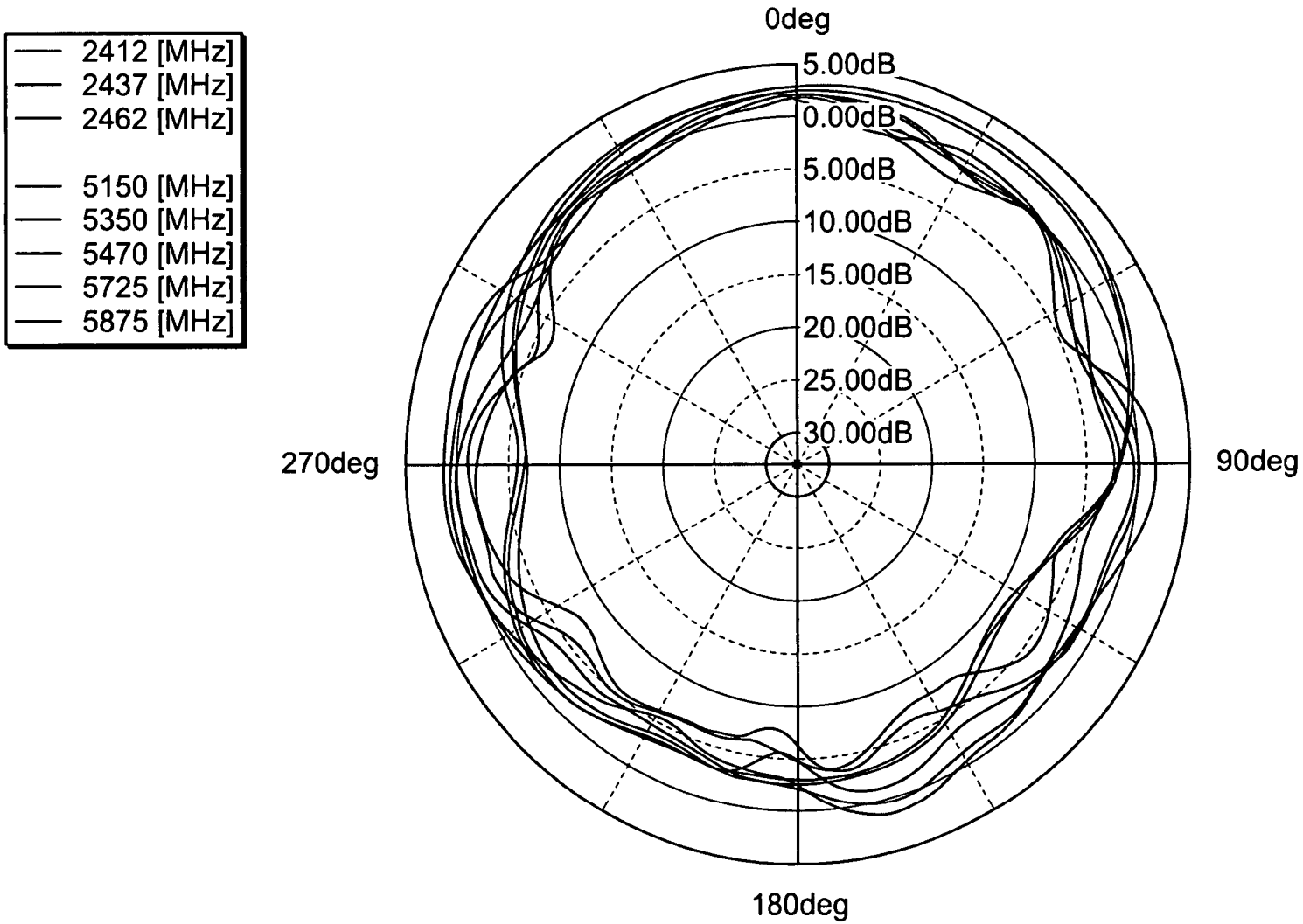
FIG. 9 is a graphical representation of the measured impedance, as a function of frequency, of a third one of the transmitting/receiving elements of the antenna array shown in FIG. 1.
Figure 10:
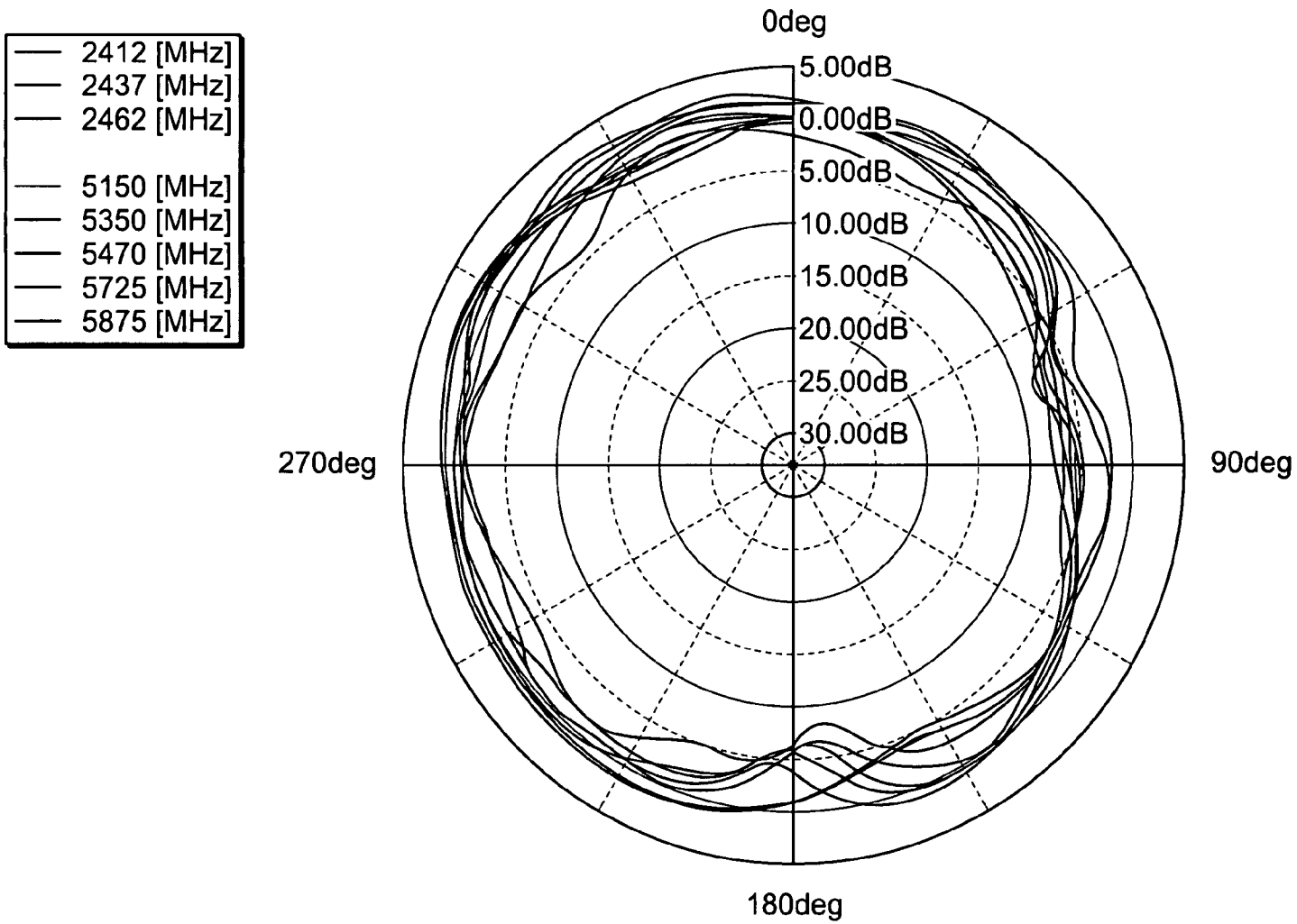
FIG. 10 is a graphical representation of the measured standing wave ratio (SWR), as a function of frequency, of the transmitting/receiving element represented by the graph of FIG. 9.
Figure 11:
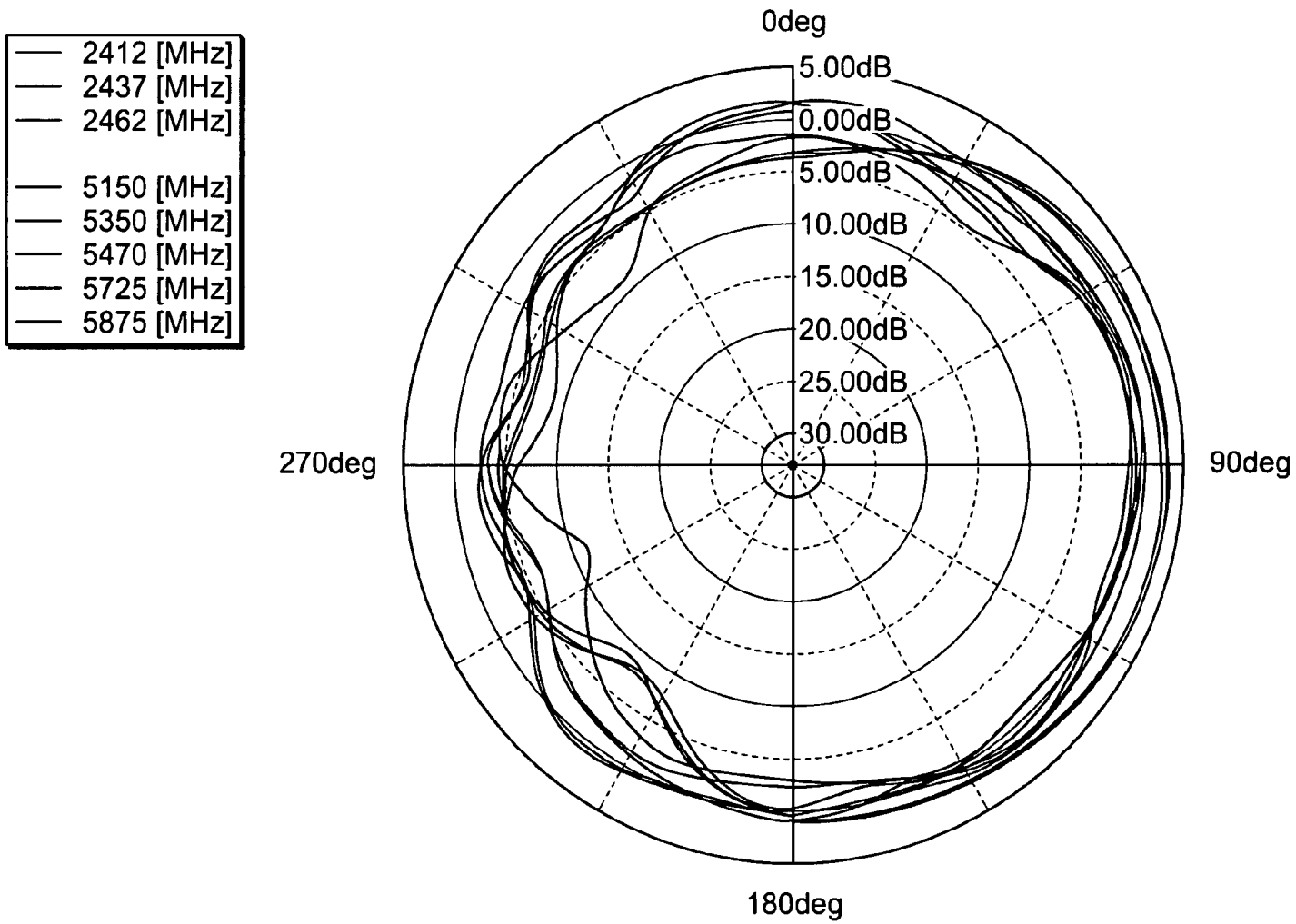
FIG. 11 is a graphical representation of the measured directional pattern, as a function of both frequency and angle, of the transmitting/receiving element represented by the graphs of FIGS. 9 and 10.
Figure 12:
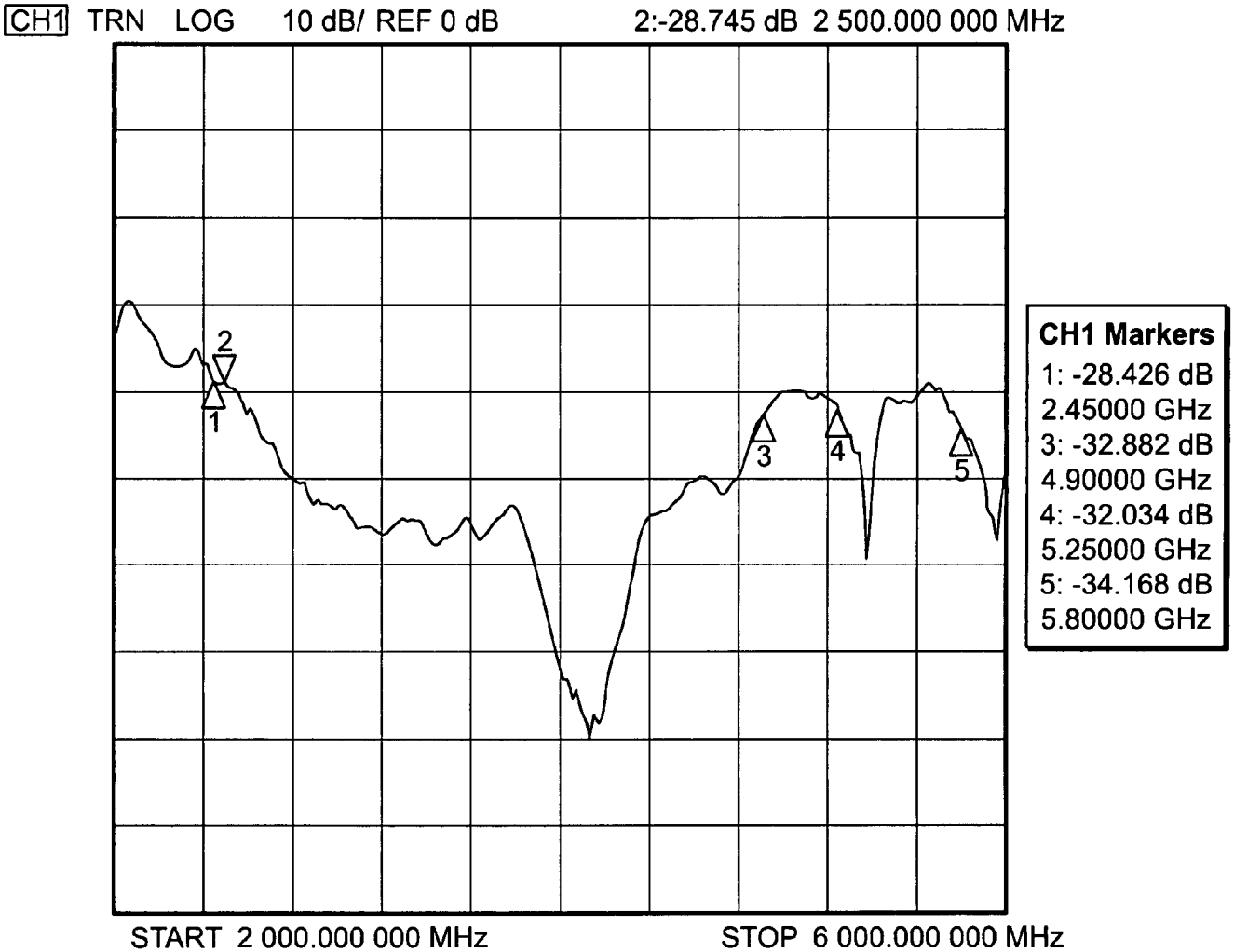
FIG. 12 is a graphical representation of the measured isolation between the first and second antenna transmitting/receiving elements of FIG. 1.
Figure 13:
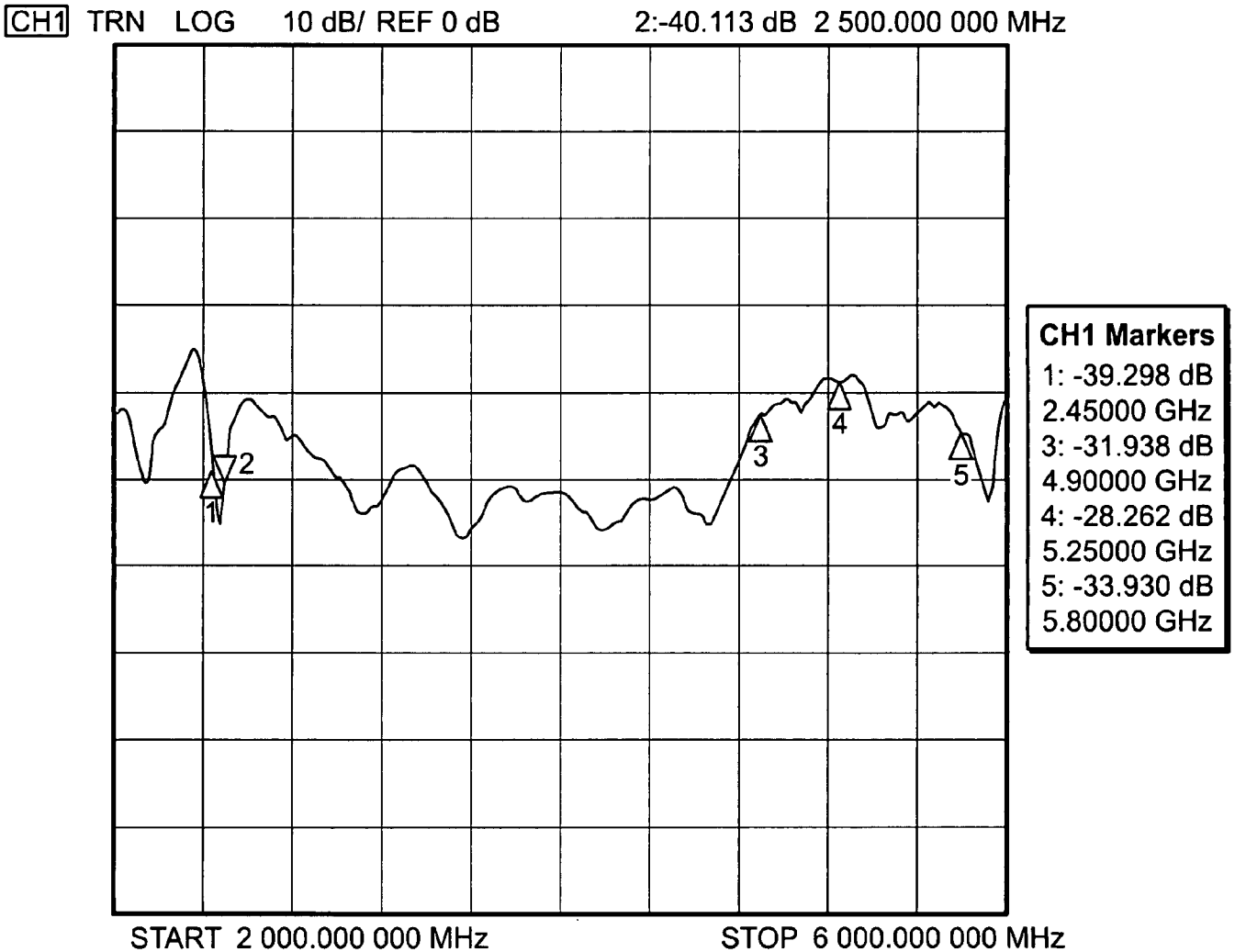
FIG. 13 is a graphical representation of the measured isolation between the first and third antenna transmitting/receiving elements of FIG. 1.
Figure 14:
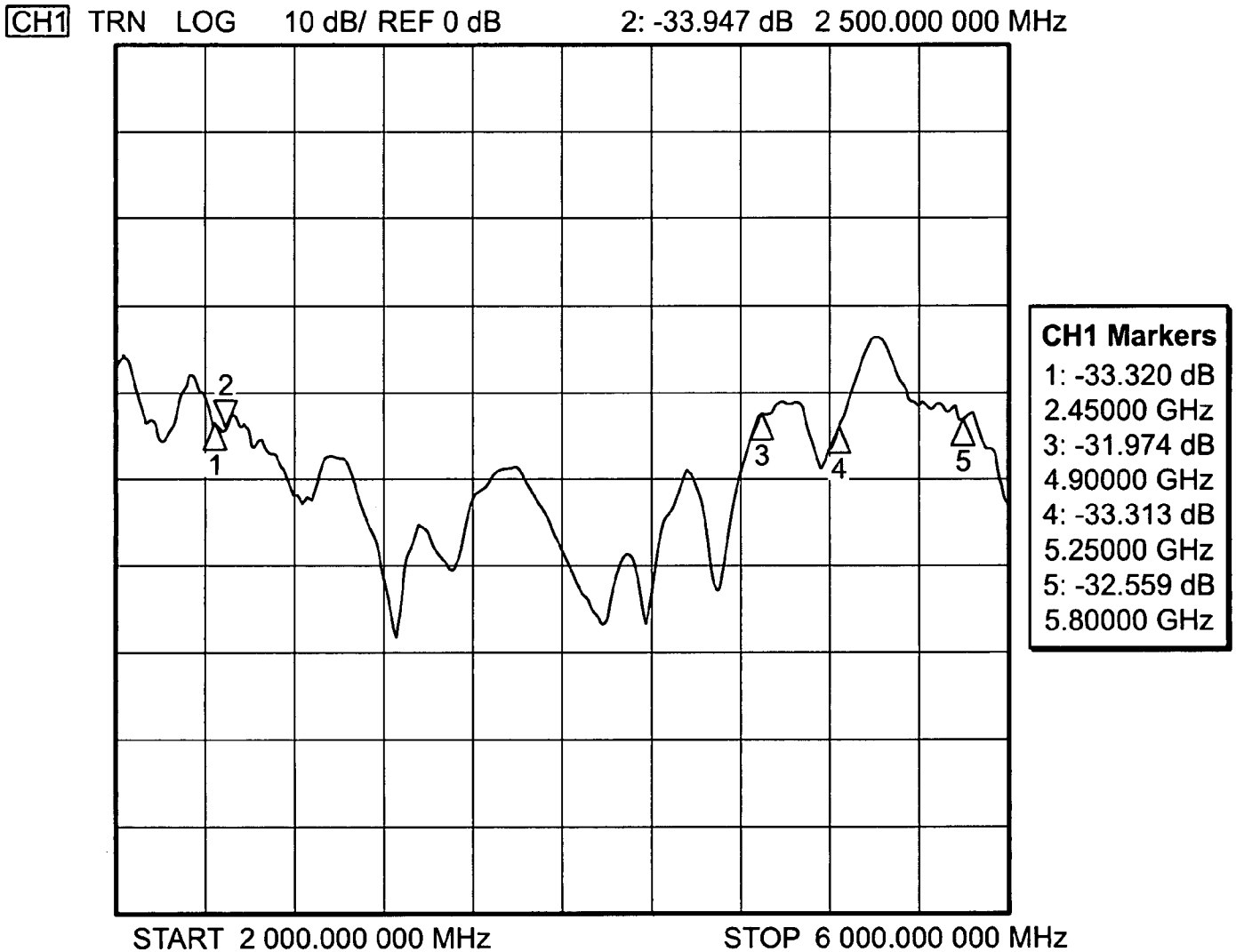
FIG. 14 is a graphical representation of the measured isolation between the second and third antenna transmitting/receiving elements of FIG. 1.

For example, parameters of three antenna transmitting/receiving elements 14 of the type shown in FIG. 2 were measured at ranges from 2.3 GHz to 6.0 GHz. Impedance measurements of these three antennas are shown in FIGS. 3, 4, and 5, for three different antenna transmitting/receiving elements 14 arbitrarily labeled A, B, and C on a metal ground plane 12. Corresponding standing wave ratio (SWR) charts are shown in FIGS. 6, 7, and 8, respectively. The nearly omnidirectional radiation patterns of antennas A, B, and C when used separately are shown in FIGS. 9, 10, and 11, respectively. With a resonant quarter-wave top-loaded monopole isolation antenna element 18 as shown in FIG. 1, the measured isolation between pairs of antenna transmitting/receiving elements 14 are shown in FIGS. 12, 13, and 14. For purposes of antenna placement, isolation of 28 dB or more (designated as −28 dB or a negative dB number of greater absolute magnitude in FIGS. 12, 13, and 14) is considered at least "about 30 dB" of isolation. Isolation of −20 dB or more is considered "substantially more than 15 dB" of isolation. In the example described herein, antenna transmitting/receiving elements 14 are resonant at a first frequency f=2.4 GHz and at least a second frequency $f_1$=5.15 GHz. More precisely, the elements are very nearly resonant within a band of frequencies ranging from $f_1$ to at least 5.85 GHz.

Any combination of the three antenna transmitting/receiving elements 14 can be used for receiving or for transmitting so as to perform beam steering or adaptive steering. Because of the enhanced isolation between elements 14, improved beam forming is possible.

Antenna array 10 configurations of the present invention are particularly useful for WIFI service. The combination of small size and enhanced isolation of at 2.4 GHz of these configurations is believed not to have heretofore been achieved. Additional monopole antenna isolation elements 18 can be added at a correct spacing (which can be determined empirically) to achieve even greater isolation at different bands. Monopole isolation element 18 can be full length, or it can be shortened or top loaded. In some configurations of the present invention, monopole antenna isolation element 18 is ¼ wavelength along, but in some other configurations, element 18 is a top-loaded ⅛ wavelength resonant monopole. In some configurations of the present invention, antenna transmitting/receiving elements 14 are planar inverted F (PIFA) antennas, as shown in FIG. 2.

Also provided in some configurations of the present invention is a method for communicating via radio frequency (RF) energy. The method can include controlling at least one of phase or amplitude of RF energy to a plurality of antenna transmitting/receiving elements 14 arranged near the periphery 16 of a ground plane 12. Each of the antenna transmitting/receiving elements 14 is resonant at least one frequency f. The method further includes providing at least one isolation antenna element 18 located on ground plane 12, between the plurality of antenna transmitting/receiving elements 14 and resonant at least the same frequency f. The plurality of transmitting/receiving elements 14 and the resonant isolation antenna element 18 are arranged on ground plane 12 so as to achieve substantially greater than 15 dB isolation between the antenna transmitting/receiving elements 14. In some configurations, the at least one resonant isolation antenna element 18 is arranged on ground plane 10 so as to achieve at least about 30 dB isolation of antenna transmitting/receiving elements 18.

Frequency f may be between 2 and 6 GHz, and the RF energy can also be between 2 and 6 GHz.

In some of these methods, antenna transmitting/receiving elements 14 are arranged equidistant from one another and each antenna transmitting/receiving element 14 is λ/4 distant from the isolation antenna element, where $$\lambda = \frac{c}{2\pi f}.$$

Some configurations of the present invention provide a method for making a high-isolation multiple in, multiple out (MIMO) antenna array 10. The method can include arranging a plurality of antenna transmitting/receiving elements 14 near the periphery 16 of a ground plane 12. Each antenna transmitting/receiving element 14 is resonant at least one frequency f. Also provided is an isolation antenna element 18, which is also resonant at least the same frequency f. Element 18 is provided between the plurality of antenna transmitting/receiving elements 14, so as to achieve substantially greater than 15 dB isolation of antenna transmitting/receiving elements 14. Some configurations of the present invention include arranging transmitting/receiving elements 14 and isolation antenna element 18 to achieves at least about 30 dB of isolation of antenna transmitting/receiving elements 14. Frequency f may be, for example, between 2 and 6 GHz. In some configurations, ground plane 12 is a metal plate. Also in some configurations, three antenna transmitting/receiving elements 14 can be arranged equidistant from one another. Each antenna transmitting/receiving element 14 may be λ/4 distant from the isolation antenna element, where $$\lambda = \frac{c}{2\pi f}.$$

In addition to other advantages cited herein, many configurations of the present invention can also provide the advantages of low angle radiation. For example, when antenna array 10 is placed on a desktop, the radiation can be focused into a relatively narrow beam that goes off to the horizon in all directions.

While the invention has been described in terms of various specific embodiments, those skilled in the art will recognize that the invention can be practiced with modification within the spirit and scope of the claims.

What is claimed is:

1. A high-isolation multiple in, multiple out (MIMO) antenna array, said array comprising:

a ground plane;

a plurality of antenna transmitting/receiving elements arranged near the periphery of the ground plane, each said antenna transmitting/receiving element resonant at a frequency f; and an isolation antenna element located on the ground plane, between said plurality of antenna transmitting/receiving elements and resonant at the same frequency f;

said plurality of antenna transmitting/receiving elements, and said resonant isolation antenna element arranged on said ground plane arranged so as to achieve substantially greater than 15 dB isolation of the antenna transmitting/receiving elements, wherein the antenna transmitting/receiving elements are dual band antenna elements that are resonant at a second frequency $f_1$ different from f, and wherein the isolation antenna element is a dual band antenna element resonant at the second frequency $f_1$.

2. An array in accordance with claim 1 wherein said plurality of antenna transmitting/receiving elements, and said resonant isolation antenna element arranged on said ground plane arranged so as to achieve at least about 30 dB isolation of the antenna transmitting/receiving elements.

3. An array in accordance with claim 1 wherein said frequency f is within the 2.4 or 5 GHz WIFI bands.

4. An array in accordance with claim 1 wherein the ground plane is a metal plate.

5. An antenna array in accordance with claim 1 comprising three antenna transmitting/receiving elements equidistant from one another and each said antenna transmitting/receiving element λ/4 distant from the isolation antenna element, where $$\lambda = \frac{c}{2\pi f}.$$

6. An array in accordance with claim 1 having a plurality of isolation antenna elements arranged to provide isolation at a plurality of different frequency bands.

7. An array in accordance with claim 1 wherein said isolation antenna element is a monopole antenna.

8. An array in accordance with claim 7 wherein said monopole antenna is ¼ wavelength at frequency f.

9. A high-isolation multiple in, multiple out (MIMO) antenna array, said array comprising:

a ground plane;

a plurality of antenna transmitting/receiving elements arranged near the periphery of the ground plane, each said antenna transmitting/receiving element resonant at a frequency f; and an isolation antenna element located on the ground plane, between said plurality of antenna transmitting/receiving elements and resonant at the same frequency f;

said plurality of antenna transmitting/receiving elements, and said resonant isolation antenna element arranged on said ground plane arranged so as to achieve substantially greater than 15 dB isolation of the antenna transmitting/receiving elements, and wherein said plurality of antenna transmitting/receiving elements comprise three antenna transmitting/receiving elements equidistant from one another and each said antenna transmitting/receiving element is λ/4 distant from the isolation antenna element, where $$\lambda = \frac{c}{2\pi f}.$$

10. An array in accordance with claim 9 wherein said plurality of antenna transmitting/receiving elements, and said resonant isolation antenna element arranged on said ground plane arranged so as to achieve at least about 30 dB isolation of the antenna transmitting/receiving elements.

11. An array in accordance with claim 9 wherein said frequency f is within the 2.4 or 5 GHz WIFI bands.

12. An array in accordance with claim 9 wherein the ground plane is a metal plate.

13. An array in accordance with claim 9 having a plurality of isolation antenna elements arranged to provide isolation at a plurality of different frequency bands.

14. An array in accordance with claim 9 wherein said isolation antenna element is a monopole antenna.

15. An array in accordance with claim 14 wherein said monopole antenna is ¼ wavelength at frequency f.

16. An array in accordance with claim 14 wherein said monopole is ⅛wavelength at frequency f and is top loaded.

17. An array in accordance with claim 9 wherein said antenna transmitting/receiving elements comprise planar inverted F antennas (PIFAs).

18. A high-isolation multiple in, multiple out (MIMO) antenna array, said array comprising:

a ground plane;

a plurality of antenna transmitting/receiving elements arranged near the periphery of the ground plane, each said antenna transmitting/receiving element resonant at a frequency f; and an isolation antenna element located on the ground plane, between said plurality of antenna transmitting/receiving elements and resonant at the same frequency f;

said plurality of antenna transmitting/receiving elements, and said resonant isolation antenna element arranged on said ground plane arranged so as to achieve substantially greater than 15 dB isolation of the antenna transmitting/receiving elements, and wherein said isolation antenna element is a monopole antenna that is ⅛ wavelength at frequency f and is top loaded.

19. A high-isolation multiple in, multiple out (MIMO) antenna array, said array comprising:

a ground plane;

a plurality of antenna transmitting/receiving elements arranged near the periphery of the ground plane, each said antenna transmitting/receiving element resonant at a frequency f and an isolation antenna element located on the ground plane, between said plurality of antenna transmitting/receiving elements and resonant at the same frequency f;

said plurality of antenna transmitting/receiving elements, and said resonant isolation antenna element arranged on said ground plane arranged so as to achieve substantially greater than 15 dB isolation of the antenna transmitting/receiving elements, and wherein said antenna transmitting/receiving elements comprise planar inverted F antennas (PIFAs).

* * * * *